US007954408B1

(12) United States Patent
Keely, Sr.

(10) Patent No.: US 7,954,408 B1
(45) Date of Patent: Jun. 7, 2011

(54) BAGEL AND ENGLISH MUFFIN SLICING APPARATUS AND ASSOCIATED METHOD

(76) Inventor: Sidney E Keely, Sr., Cerritos, CA (US)

( * ) Notice: Subject to any disclaimer, the term of this patent is extended or adjusted under 35 U.S.C. 154(b) by 527 days.

(21) Appl. No.: 12/072,055

(22) Filed: Feb. 22, 2008

Related U.S. Application Data

(60) Provisional application No. 60/902,870, filed on Feb. 23, 2007.

(51) Int. Cl.
*B26D 7/02* (2006.01)
*B26D 3/30* (2006.01)

(52) U.S. Cl. ..... 83/762; 83/870; 83/454; 83/761

(58) Field of Classification Search ..... 30/277.4, 30/298.4, 296.1, 272.1, 298, 286, 289, 290, 30/114, 124, 136.5, 294, 305, 315; 83/13, 83/762, 870, 454, 544, 697, 932, 466.1, 613, 83/636, 761; 269/87.2, 295
See application file for complete search history.

(56) References Cited

U.S. PATENT DOCUMENTS

| | | | | | |
|---|---|---|---|---|---|
| 1,623,498 | A * | 4/1927 | Sandbeck | 83/762 |
| 2,172,538 | A * | 9/1939 | Katzinger | 83/762 |
| 4,399,989 | A * | 8/1983 | Baillie | 269/87.2 |
| 5,386,755 | A * | 2/1995 | Schneider et al. | 83/762 |
| 5,431,078 | A * | 7/1995 | Ricard et al. | 83/870 |
| 5,577,430 | A * | 11/1996 | Gunderson et al. | 83/870 |
| 6,202,529 | B1 * | 3/2001 | Hodsdon | 83/870 |
| 7,007,583 | B1 * | 3/2006 | Fiola | 83/870 |

* cited by examiner

*Primary Examiner* — Ghassem Alie

(57) ABSTRACT

A manually operable culinary apparatus includes a bottom cradle with a planar base member, a plurality of walls, a plurality of support plates, and a cutting implement detachably engaged with the bottom cradle in such a manner that the cutting implement is abutted directly on the bottom cradle when vertically and linearly displaced along a vertical plane such that a bottom-most tip of the cutting implement travels beyond the support edges and terminates medially between the support edges respectively. The apparatus further includes a mechanism for selectively adjusting first and second lateral spatial distances defined between the support plates and the anterior and posterior walls respectively.

10 Claims, 8 Drawing Sheets

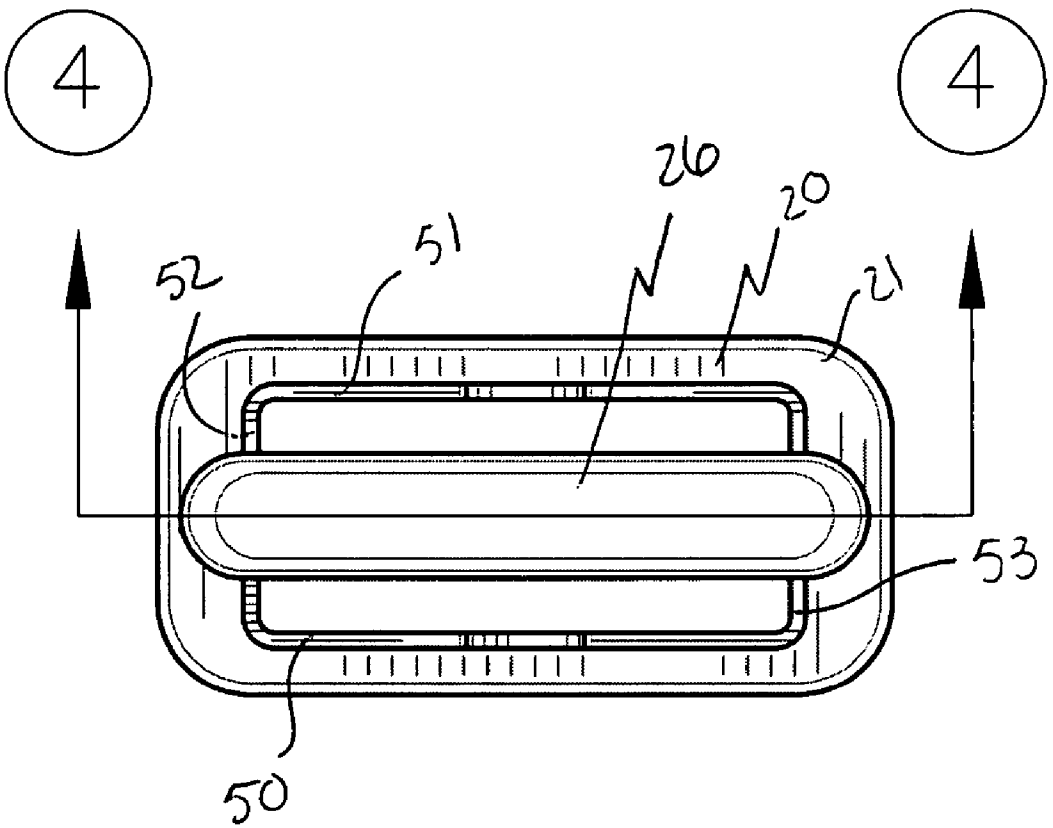
FIG. 3
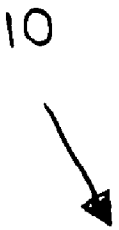

BAGEL AND ENGLISH MUFFIN SLICING APPARATUS AND ASSOCIATED METHOD

CROSS REFERENCE TO RELATED APPLICATIONS

This application claims the benefit of U.S. Provisional Application No. 60/902,870, filed Feb. 23, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a slicing apparatus and, more particularly, to a bagel and English muffin slicing apparatus for slicing an existing bread product.

2. Prior Art

The conventional slicing procedure for a bagel requires the user to place the bagel on its circumferential edge in an upright manner and be held by the hand of the user. The user then directs a knife blade longitudinally through the bagel attempting to divide the bagel into two relatively equal halves. This type of cutting procedure is difficult for many people and has resulted in a large number of hand cuts. Additionally, some people prefer to cut the bagel into three pieces as opposed to two which produces narrower separate pieces which not only facilitate the toasting procedure but also produces a more toasted end food product. The dividing of a bagel into thirds by this hand technique causes the user to be even more prone to injury. There is a need to incorporate a simplified and safe form of holder device in conjunction with a conventional toaster that can be used by the user to slice a bagel or muffin into a plurality of separate pieces with the slicing procedure to be accomplished in a safe manner. In addition, these bagel cutters rarely operate in a manner that allows a user to cut a smaller English muffin. Based on the above mentioned needs, it would be advantageous to provide a user a means to cut smaller English muffins with the bagel cutter.

U.S. Pat. No. 4,399,989 to Baillie discloses a fixture having a channel for accepting a user inserted knife blade, a first, floating plate for holding in place one surface of the bagel, roll or muffin to be sliced, and a second, rigid plate for bearing against the opposite surface of the bagel, roll or muffin, and positionally adjustable with respect to the channel for controlling the thickness of the resulting sliced sections. Unfortunately, this prior art example does not provide a method for augmenting a standard bagel cutter.

U.S. Pat. No. 5,673,608 to DeMars discloses a food cutting holder mounted in conjunction with a toaster for toasting bagels, muffins, bread slices and other similar types of foodstuff. The food cutting holder is to be confinable within the housing of the toaster when in the storage position and removable from the housing when it is intended to be used. The food cutting holder confiningly locates the food item in a precise position facilitating division of the food item into a plurality of separate pieces. It is intended that these separate pieces are then to be toasted within the toaster. Unfortunately, this prior art example does not provide a method for augmenting a standard bagel cutter.

U.S. Pat. No. 6,202,529 to Hodsdon discloses an invention that is a safe, effective, attractive apparatus for slicing bread products such as bagels, bulkie rolls, and English muffins into two approximately equal sections. The invention is comprised of two primary components. The base unit is essentially a rectangular block with a narrow slot on either side of a cavity that is open at the top and shaped to receive and center a bread product. The second component is a unique separate top block that has an inverted slot on the underside to receive a knife so that it is recessed from the underside of the top block. A knife is placed into the slot of the top block, and together they are placed into the chamber of the base unit, with the knife now guided by the slots on either side of the base unit. The top block is used to hold down the bread product to keep it from rotating, while keeping fingers safely away from the knife blade. The user draws the knife back and forth, and is able to cut easily through the bread product. Unfortunately, this prior art example requires a user to operate a knife in order to achieve the desired result.

Accordingly, the present invention is disclosed in order to overcome the above noted shortcomings. The manually operable culinary apparatus is convenient and easy to use, lightweight yet durable in design, and designed for slicing an existing bread product. The apparatus is simple to use, inexpensive, and designed for many years of repeated use.

BRIEF SUMMARY OF THE INVENTION

In view of the foregoing background, it is therefore an object of the present invention to provide an apparatus for slicing an existing bread product. These and other objects, features, and advantages of the invention are provided by a manually operable culinary apparatus.

A manually operable culinary apparatus includes a bottom cradle with a planar base member and a plurality of walls monolithically formed therewith. Such walls are effectively configured in such a manner to define a receiving cavity therebetween. The apparatus further includes a plurality of support plates intercalated between anterior and posterior ones of the walls and a plurality of support edges onto which the existing bread product is held. Each of such support plates has lateral sides directly conjoined to left and right ones of the walls respectively, and each of the support edges of the support plates are equidistantly offset from the anterior and posterior walls. Each of the first and second support plates is coextensively shaped and centrally aligned within the receiving cavity such that the first and second support plates contiguously lay parallel to the anterior and posterior walls.

The apparatus further includes a cutting implement detachably engaged with the bottom cradle in such a manner that the cutting implement is conveniently abutted directly on the bottom cradle when vertically and linearly displaced along a vertical plane such that a bottom-most tip of the cutting implement travels beyond the support edges and terminates medially between the support edges respectively. Such a cutting implement has a U-shaped handle suitably sized and shaped so that opposed bottom ends of the U-shaped handle directly engage the base member when the cutting implement is displaced to a lower most cutting position. The cutting implement is provided with symmetrically opposed linear sides converging downwardly from opposed walls of the U-shaped handle and towards a center of the cutting implement and further terminating at an apex defined at the bottom-most tip thereof.

The apparatus further includes a mechanism for selectively adjusting first and second lateral spatial distances defined between the support plates and the anterior and posterior walls respectively. Such a first and second spatial distance adjusting mechanism advantageously includes first and second inserts positioned within the receiving cavity and abutted directly against the anterior and posterior walls respectively, and a plurality of clips positioned about respective top edges of the anterior and posterior walls as well as the first and second inserts such that the first and second inserts remain statically coupled to the anterior and posterior walls during slicing operations.

Each of the top edges of the inserts effectively slope downwardly and inwardly towards a center of the anterior and posterior walls respectively and terminate at a curvilinear apex defined approximately midway between top and bottom ends of the posterior and anterior walls respectively. Further, each of the first and second inserts is coextensively shaped and has corresponding top edges substantially aligned with the top edges of the posterior and anterior walls respectively.

A method for slicing an existing bread product includes the steps of: providing a bottom cradle with a planar base member; configuring a plurality of walls with the base member in such a manner to define a receiving cavity between the walls; intercalating a plurality of support plates between anterior and posterior ones of the walls by directly conjoining lateral sides of each of the support plates to left and right ones of the walls respectively; selectively adjusting first and second lateral spatial distances defined between the support plates and the anterior and posterior walls respectively; positioning the existing bread product on a plurality of support edges of the support plates respectively; providing a cutting implement; and detachably engaging the cutting implement with the bottom cradle by vertically and linearly displacing the cutting implement along a vertical plane such that a bottom-most tip of the cutting implement travels through the existing bread-product and beyond the support edges and thereby enables the cutting implement to terminate medially between the support edges respectively.

The method further includes the steps of: positioning first and second inserts within the receiving cavity by directly abutting the first and second inserts against the anterior and posterior walls respectively; and positioning a plurality of clips about respective top edges of the anterior and posterior walls as well as top edges of the first and second inserts such that the first and second inserts remain statically coupled to the anterior and posterior walls during slicing operations.

The method further includes the steps of: equidistantly offsetting each of the support edges of the support plates from the anterior and posterior walls by centrally aligning each of the support plates within the receiving cavity and further by contiguously laying the first and second support plates parallel to the anterior and posterior walls respectively; situating the first and second inserts within the bottom cradle in such a manner that each of the top edges of the inserts slope downwardly and inwardly towards a center of the anterior and posterior walls respectively and terminate at a curvilinear apex defined approximately midway between top and bottom ends of the posterior and anterior walls respectively; and substantially aligning top edges of the first and second inserts with the top edges of the posterior and anterior walls respectively.

The method further includes the steps of: providing a U-shaped handle; and displacing the U-shaped handle to a lower most cutting position by directly engaging opposed bottom ends of the U-shaped handle with the base member such that the bottom-most tip of the cutting implement terminates at the base member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 3 is a top planar view of the manually operable culinary apparatus, in accordance with the present invention;

DETAILED DESCRIPTION OF THE INVENTION

Figure 1:
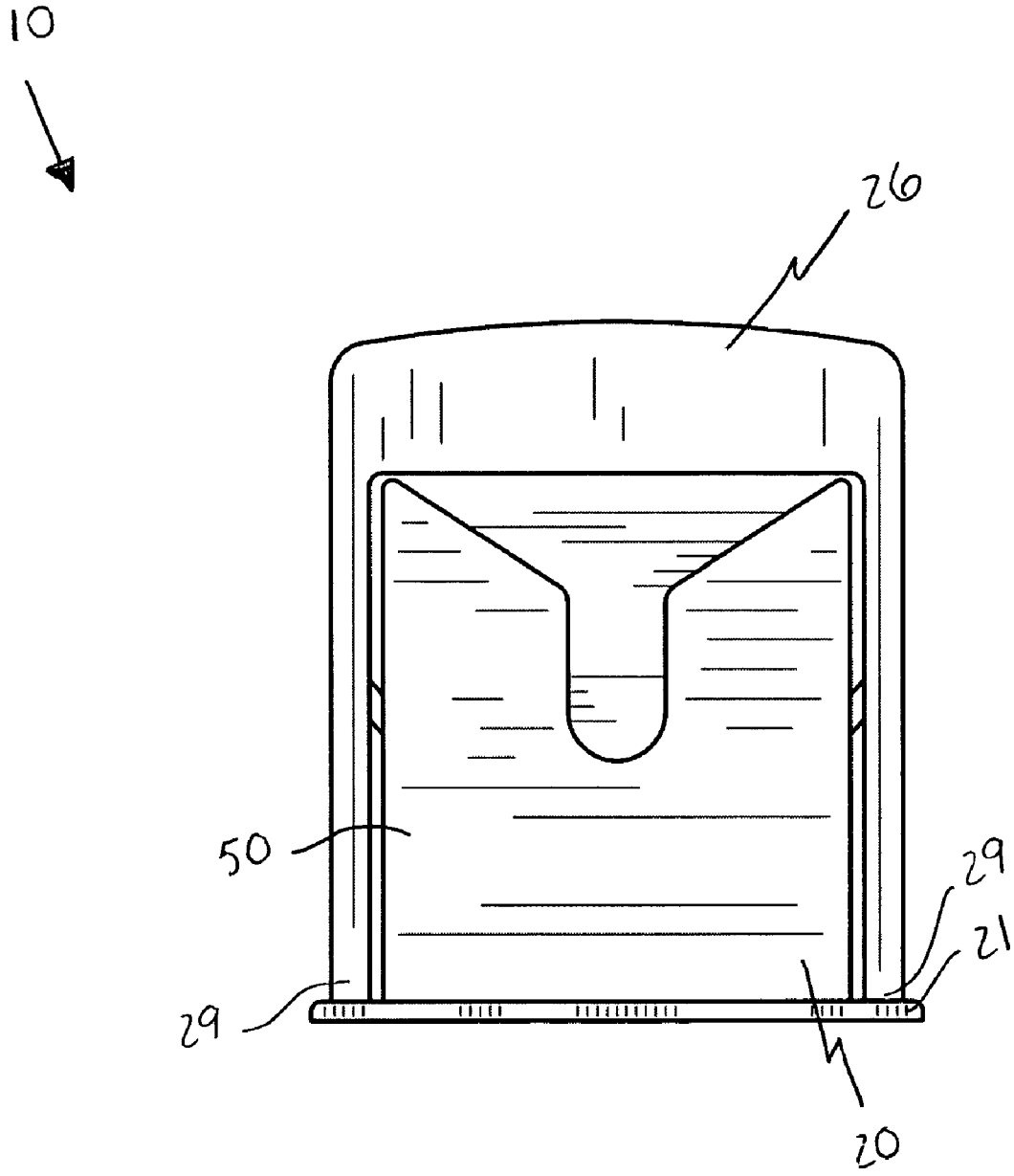
FIG. 1 is a front elevational view of a manually operable culinary apparatus, in accordance with the present invention.
Figure 2:
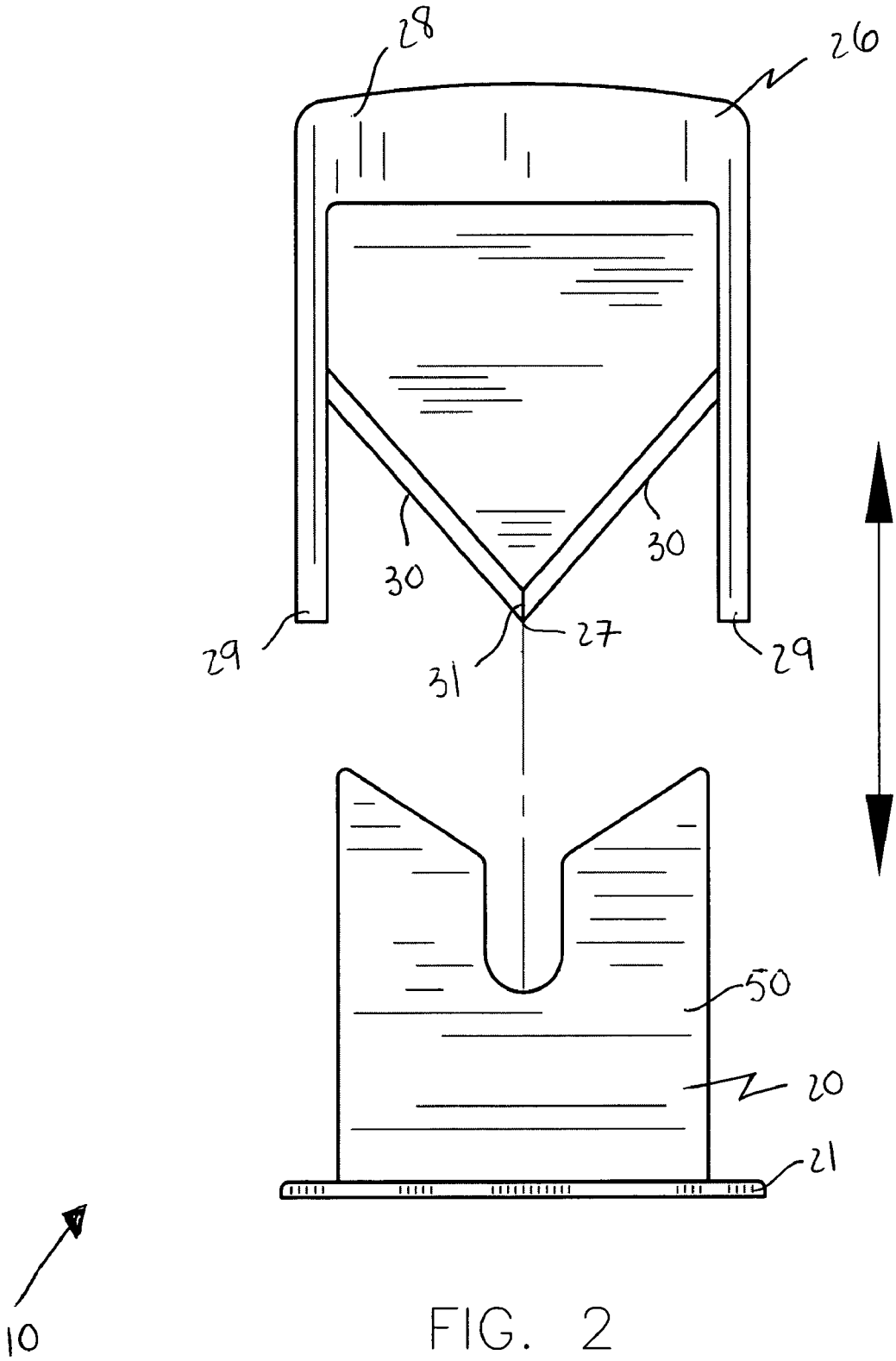
FIG. 2 is an exploded front view of the manually operable culinary apparatus, in accordance with the present invention.
Figure 4:
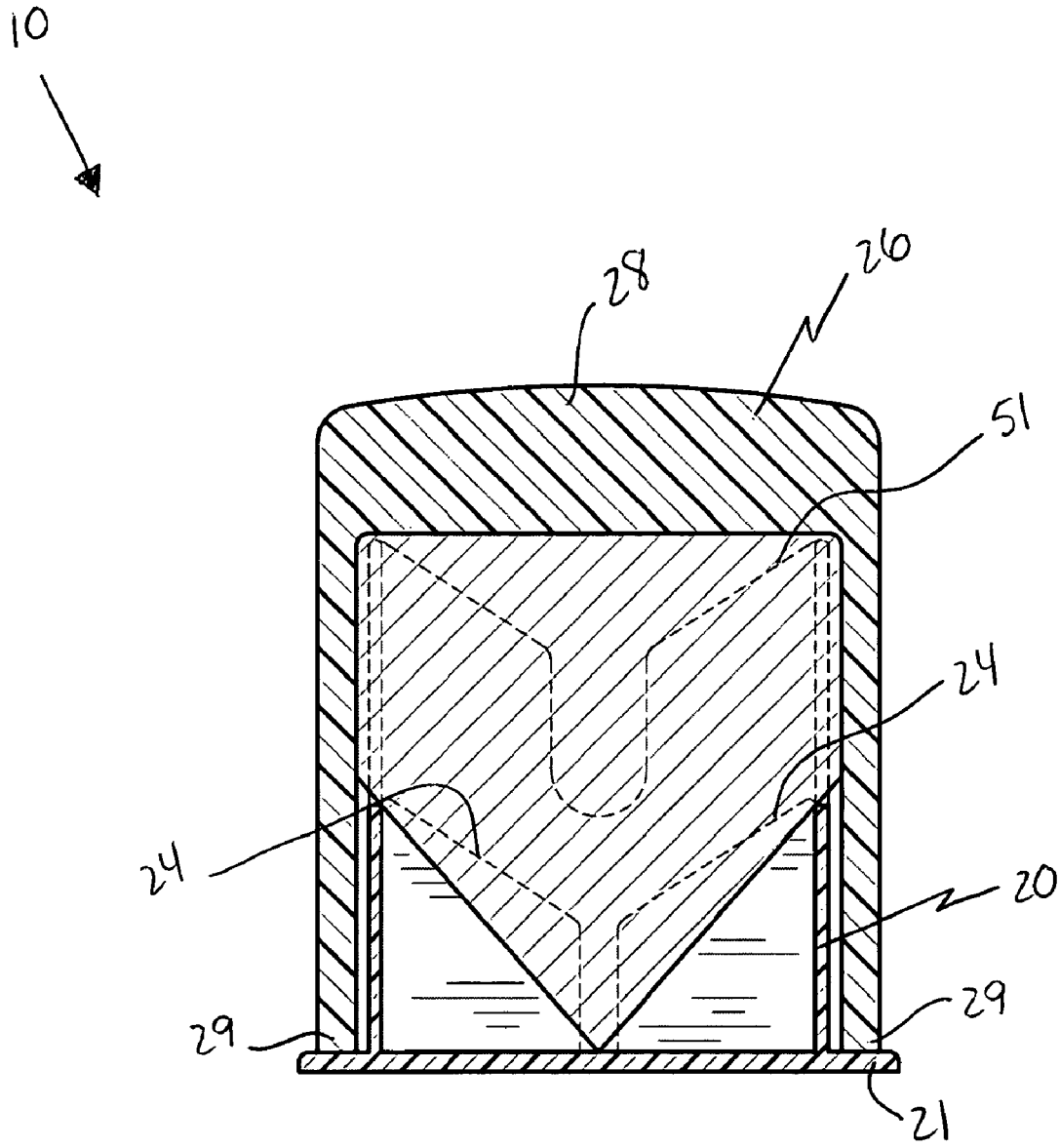
FIG. 4 is a cross sectional view of the manually operable culinary apparatus, taken along line 4-4, as seen in FIG. 3.
Figure 5:
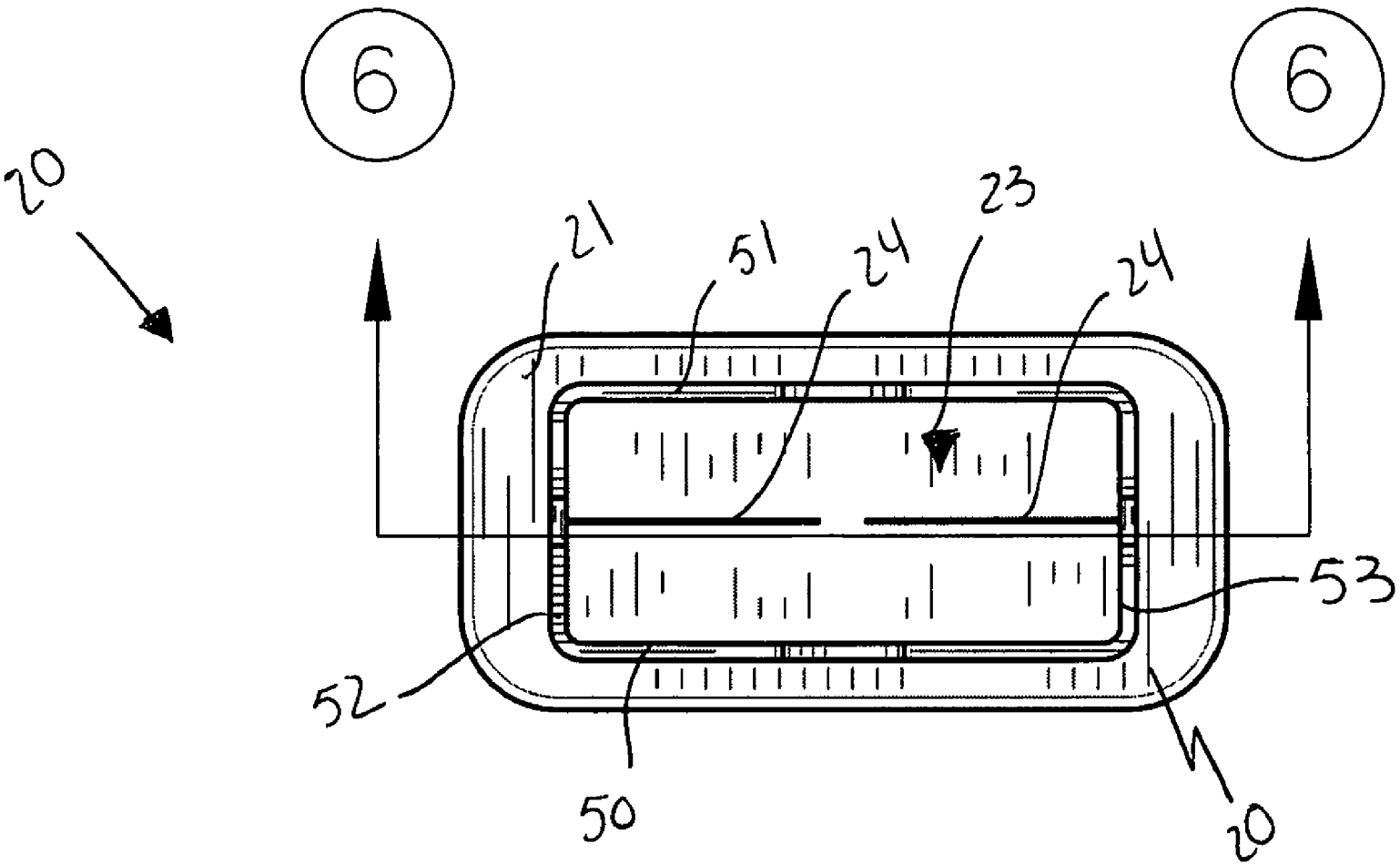
FIG. 5 is a top planar view of the bottom cradle, in accordance with the present invention.
Figure 6:
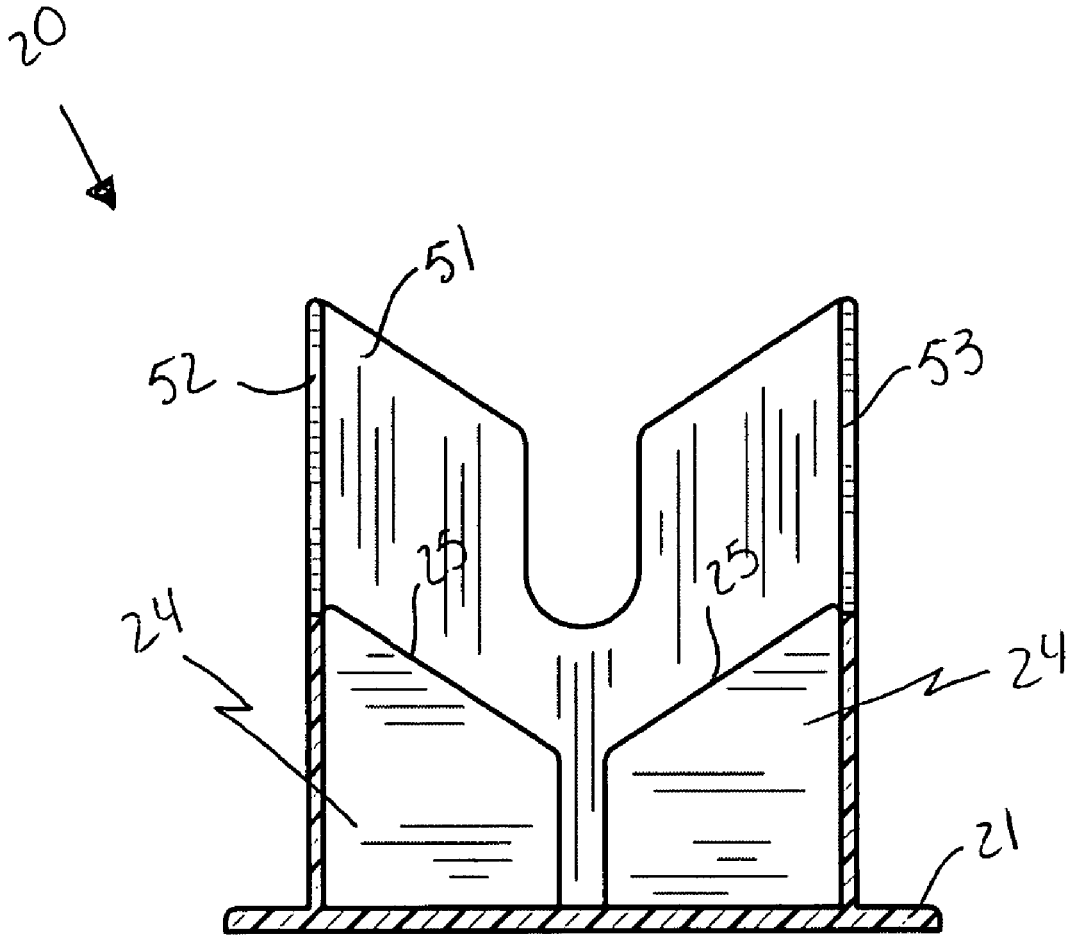
FIG. 6 is a cross sectional view of the bottom cradle, taken along line 5-5, as seen in FIG. 5.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-8 by the reference numeral 10 and is intended to protect a manually operable culinary apparatus. It should be understood that the apparatus 10 may be used to slice many different types of bread products and should not be limited to use with only those types of bread products mentioned herein.

Referring initially to FIGS. 1, 2, 3, 4, 5, 6, 7 and 8, a manually operable culinary apparatus 10 includes a bottom cradle 20 with a planar base member 21 and a plurality of walls 50, 51, 52, 53 monolithically formed therewith. Such walls 50, 51, 52, 53 are configured in such a manner to define a receiving cavity 23 therebetween. The apparatus 10 further includes a plurality of support plates 24 intercalated between anterior and posterior ones of the walls 50, 51 and a plurality of support edges 25 onto which the existing bread product is held. Each of such support plates 24 has lateral sides directly conjoined, without the use of intervening elements, to left and right ones of the walls 52, 53 respectively, and each of the support edges 25 of the support plates 24 are equidistantly offset from the anterior and posterior walls 50, 51. Each of the first and second support plates 24 is coextensively shaped and centrally aligned within the receiving cavity 23 which is essential such that the first and second support plates 24 contiguously lay parallel to the anterior and posterior walls 50, 51. The support plates 24 maintain the existing bread product in a fixed position during cutting procedures.

Referring to FIGS. 1, 2, 3 and 4, the apparatus 10 further includes a cutting implement 26 detachably engaged with the bottom cradle 20 in such a manner that the cutting implement 26 is abutted directly, without the use of intervening elements, on the bottom cradle 20 when vertically and linearly displaced along a vertical plane which is important such that a bottom-most tip 27 of the cutting implement 26 travels beyond the support edges 25 and terminates medially between the support edges 25 respectively. Such a cutting implement 26 has a U-shaped handle 28 suitably sized and shaped which is crucial so that opposed bottom ends 29 of the U-shaped handle 28 directly engage, without the use of intervening elements, the base member 21 when the cutting implement 26 is displaced to a lower most cutting position. The cutting implement 26 is provided with symmetrically opposed linear sides 30 converging downwardly from opposed walls of the U-shaped handle 26 and towards a center of the cutting implement 26 and further terminating at an apex 31 defined at the bottom-most tip thereof. The cutting implement 26 provides a user a smoothly and evenly sliced bread product ideal for toasting.

Figure 7:
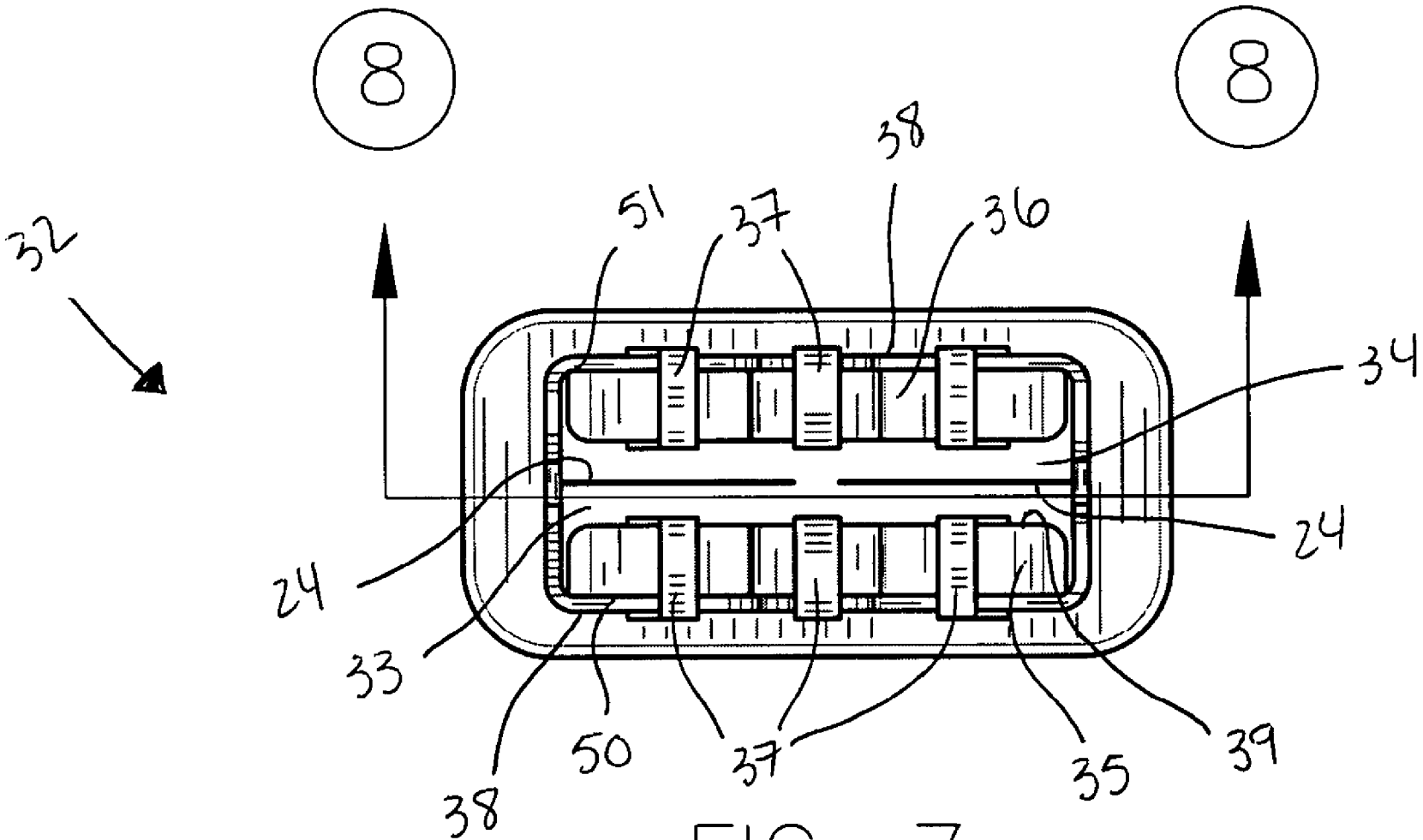
FIG. 7 is a top planar view of the bottom cradle, showing the placement of the first and second inserts, in accordance with the present invention.
Figure 8:
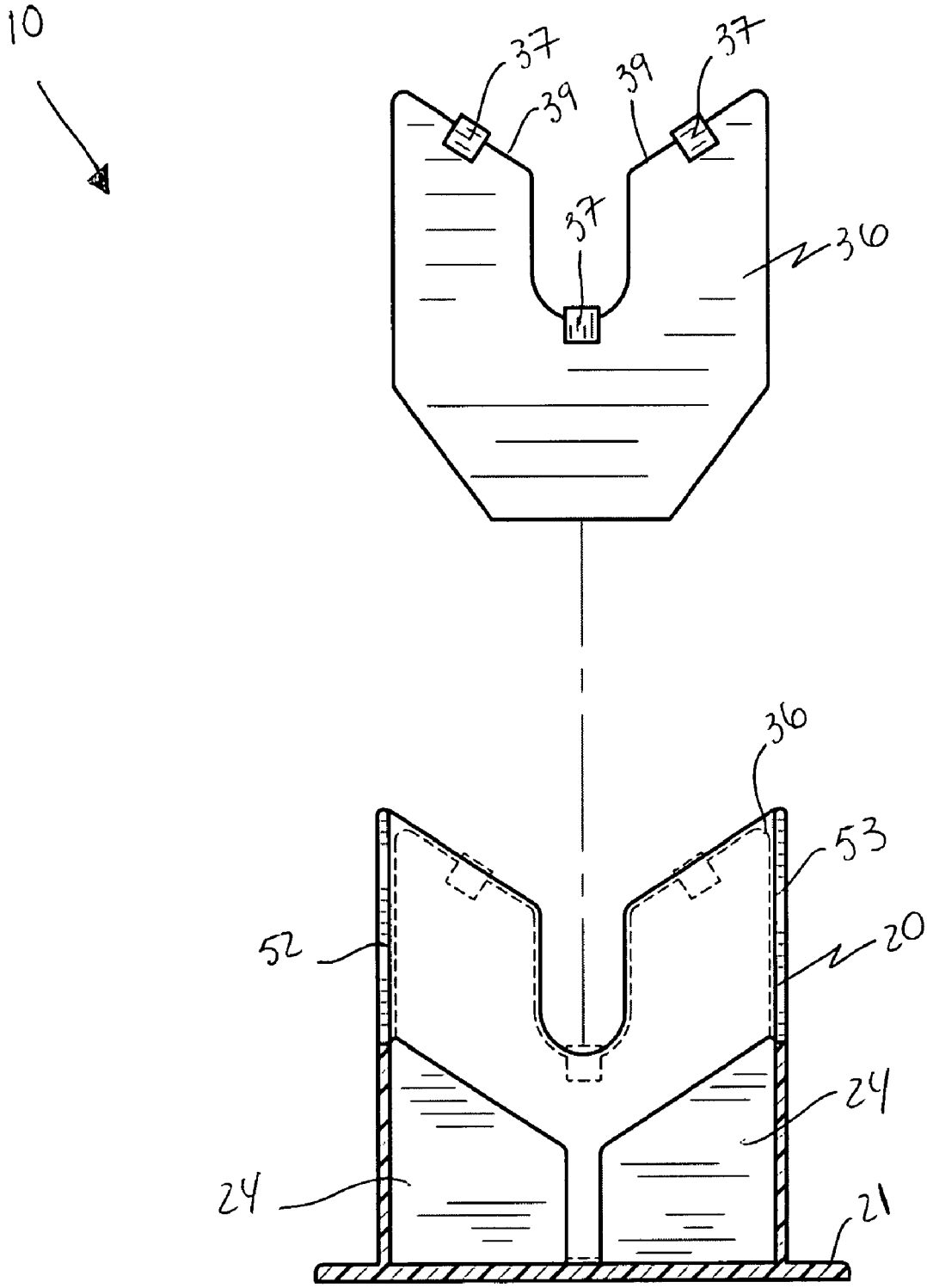
FIG. 8 is a cross sectional and exploded view of the bottom cradle, taken along line 8-8, as seen in FIG. 7.

Referring to FIGS. 7 and 8, the apparatus 10 further includes a mechanism 32 for selectively adjusting first and second lateral spatial distances 33, 34 defined between the support plates 24 and the anterior and posterior walls 50, 51 respectively. Such a first and second spatial distance adjusting mechanism 32 includes first and second inserts 35, 36 positioned within the receiving cavity 23 and abutted directly, without the use of intervening elements, against the anterior and posterior walls 50, 51 respectively, and a plurality of clips 37 positioned about respective top edges 38 of the anterior and posterior walls 50, 51 as well as the first and second inserts 35, 36 which is vital such that the first and second inserts 35, 36 remain statically coupled to the anterior and posterior walls 50, 51 during slicing operations.

Each of the top edges 39 of the inserts 35, 36 slope downwardly and inwardly towards a center of the anterior and posterior walls 50, 51 respectively and terminate at a curvilinear apex defined approximately midway between top and bottom ends of the posterior and anterior walls 50, 51 respectively. Further, each of the first and second inserts 35, 36 is coextensively shaped and has corresponding top edges 39 substantially aligned with the top edges 38 of the posterior and anterior walls 50, 51 respectively. The inserts 35, 36 enable a user to easily slice smaller bread products such as English muffins.

The apparatus includes a specially designed enhancement to bagel cutters that adds an adapter to accommodate the smaller English muffin. The base bagel cutter is of the "guillotine" style, comprised of two sections. The bottom cradle is made of plastic to hold the bagel in an upright position, while the upper portion consists of a V-shaped, stainless steel cutting implement held by a plastic handle. As the handle and cradle fit together neatly, one can simply put a bagel in place, place the sleeve on top, and then push down on the handle which cleanly cuts through the bagel. The apparatus incorporates adding a series of spring-operated plastic inserts into the cradle of the device, each measuring approximately four and one half inches in length and width, and one quarter inch in depth, as an example. The inserts are manually positioned in order to contact the cradle area and securely accommodate an English muffin, allowing the breakfast bread to be expediently and neatly sliced in two, just like a bagel. This versatile addition to the bagel cutter is simply placed into the device when one wishes to enjoy an English muffin, and just as easily removed to slice a bagel.

The present invention, as claimed, provides the unexpected and unpredictable benefit of an apparatus that is convenient and easy to use, is lightweight yet durable in design, and provides a user a means to cut smaller. English muffins with the bagel cutter. Such an apparatus offers consumers an easy and effortless means of neatly slicing an English muffin into perfect halves. By simply augmenting a standard bagel cutter with specially designed tensioned inserts, the apparatus provides an instant slicer for these smaller alternatives to bagels. In this manner, the apparatus eliminates the need to pry apart a muffin with the fingers, as well as risk cuts from trying to employ a knife for this purpose. The apparatus is especially ideal for consumers who suffer from limited physical capabilities, alleviating painful and fruitless attempts at slicing for users with palsy, arthritis, or Parkinson's disease. The present invention is inexpensive, simple to use, and designed for many years of repeated use.

In use, a method for slicing an existing bread product includes the steps of: providing a bottom cradle 20 with a planar base member 21; configuring a plurality of walls 50, 51, 52, 53 with the base member 21 in such a manner to define a receiving cavity 23 between the walls; intercalating a plurality of support plates 24 between anterior and posterior ones of the walls 50, 51 by directly conjoining, without the use of intervening elements, lateral sides of each of the support plates 24 to left and right ones of the walls 52, 53 respectively; selectively adjusting first and second lateral spatial distances defined between the support plates 24 and the anterior and posterior walls 50, 51 respectively; positioning the existing bread product on a plurality of support edges 25 of the support plates 24 respectively; providing a cutting implement 26; and detachably engaging the cutting implement 26 with the bottom cradle 20 by vertically and linearly displacing the cutting implement 26 along a vertical plane such that a bottom-most tip 27 of the cutting implement 26 travels through the existing bread-product and beyond the support edges 25 and thereby enables the cutting implement 26 to terminate medially between the support edges 25 respectively.

In use, the method further includes the steps of: positioning first and second inserts 35, 36 within the receiving cavity 23 by directly abutting, without the use of intervening elements, the first and second inserts 35, 36 against the anterior and posterior walls 50, 51 respectively; and positioning a plurality of clips 27 about respective top edges 38 of the anterior and posterior walls 50, 51 as well as top edges 39 of the first and second inserts 35, 36 such that the first and second inserts 35, 36 remain statically coupled to the anterior and posterior walls 50, 51 during slicing operations.

In use, the method further includes the steps of: equidistantly offsetting each of the support edges 25 of the support plates 24 from the anterior and posterior walls 50, 51 by centrally aligning each of the support plates 24 within the receiving cavity 23 and further by contiguously laying the first and second support plates 24 parallel to the anterior and posterior walls 50, 51 respectively; situating the first and second inserts 35, 36 within the bottom cradle 20 in such a manner that each of the top edges 39 of the inserts 35, 36 slope downwardly and inwardly towards a center of the anterior and posterior walls 50, 51 respectively and terminate at a curvilinear apex defined approximately midway between top and bottom ends of the posterior and anterior walls 50, 51 respectively; and substantially aligning top edges of the first and second inserts 35, 36 with the top edges 38 of the posterior and anterior walls 50, 51 respectively.

In use, the method further includes the steps of: providing a U-shaped handle 28; and displacing the U-shaped handle 28 to a lower most cutting position by directly engaging, without the use of intervening elements, opposed bottom ends 29 of the U-shaped handle 28 with the base member 21 such that the bottom-most tip 27 of the cutting implement 26 terminates at the base member 21.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A manually operable culinary apparatus for slicing an existing bread product, said manually operable culinary apparatus comprising:

a bottom cradle having a plurality of walls configured to define a receiving cavity therebetween;

a plurality of support plates intercalated between anterior and posterior ones of said walls and providing a plurality of support edges onto which the existing bread product is held;

a cutting implement detachably engaged with said bottom cradle in such a manner that said cutting implement is abutted directly on said bottom cradle when vertically and linearly displaced along a vertical plane such that a bottom-most tip of said cutting implement traveling beyond said support edges and terminates medially between said support edges respectively; and means for selectively adjusting first and second lateral spatial distances defined between said support plates and said anterior and posterior walls respectively;

wherein said first and second spatial distance adjusting means comprises:

first and second inserts positioned within said receiving cavity and abutted directly against said anterior and posterior walls respectively; and a plurality of clips positioned about respective top edges of said anterior and posterior walls as well as said first and second inserts such that said first and second inserts remain statically coupled to said anterior and posterior walls during slicing operations.

2. The manually operable culinary apparatus of claim 1, wherein each of said support edges of said support plates are equidistantly offset from said anterior and posterior walls, each of said first and second support plates being coextensively shaped and centrally aligned within said receiving cavity such that said first and second support plates contiguously lay parallel to said anterior and posterior walls.

3. The manually operable culinary apparatus of claim 1, wherein each of said top edges of said inserts slope downwardly and inwardly towards a center of said anterior and posterior walls respectively and terminate at a curvilinear apex defined approximately midway between top and bottom ends of said posterior and anterior walls respectively.

4. The manually operable culinary apparatus of claim 1, wherein each of said first and second inserts are coextensively shaped and have corresponding top edges substantially aligned with said top edges of said posterior and anterior walls respectively.

5. The manually operable culinary apparatus of claim 1, wherein said cutting implement is provided with symmetrically opposed linear sides converging downwardly towards a center of said cutting implement and terminating at an apex defined at said bottom-most tip thereof.

6. A manually operable culinary apparatus for slicing an existing bread product, said manually operable culinary apparatus comprising:

a bottom cradle having a planar base member and a plurality of walls monolithically formed therewith, said walls being configured in such a manner to define a receiving cavity therebetween;

a plurality of support plates intercalated between anterior and posterior ones of said walls and providing a plurality of support edges onto which the existing bread product is held, each of said support plates having lateral sides directly conjoined to left and right ones of said walls respectively;

a cutting implement detachably engaged with said bottom cradle in such a manner that said cutting implement is abutted directly on said bottom cradle when vertically and linearly displaced along a vertical plane such that a bottom-most tip of said cutting implement traveling beyond said support edges and terminates medially between said support edges respectively; and means for selectively adjusting first and second lateral spatial distances defined between said support plates and said anterior and posterior walls respectively;

wherein said first and second spatial distance adjusting means comprises first and second inserts positioned within said receiving cavity and abutted directly against said anterior and posterior walls respectively; and a plurality of clips positioned about respective top edges of said anterior and posterior walls as well as said first and second inserts such that said first and second inserts remain statically coupled to said anterior and posterior walls during slicing operations.

7. The manually operable culinary apparatus of claim 6, wherein each of said support edges of said support plates are equidistantly offset from said anterior and posterior walls, each of said first and second support plates being coextensively shaped and centrally aligned within said receiving cavity such that said first and second support plates contiguously lay parallel to said anterior and posterior walls.

8. The manually operable culinary apparatus of claim 6, wherein each of said top edges of said inserts slope downwardly and inwardly towards a center of said anterior and posterior walls respectively and terminate at a curvilinear apex defined approximately midway between top and bottom ends of said posterior and anterior walls respectively.

9. The manually operable culinary apparatus of claim 6, wherein each of said first and second inserts are coextensively shaped and have corresponding top edges substantially aligned with said top edges of said posterior and anterior walls respectively.

10. The manually operable culinary apparatus of claim 6, wherein said cutting implement has a U-shaped handle suitably sized and shaped so that opposed bottom ends of said U-shaped handle directly engage said base member when said cutting implement is displaced to a lower most cutting position, said cutting implement being provided with symmetrically opposed linear sides converging downwardly from opposed walls of said U-shaped handle and towards a center of said cutting implement and further terminating at an apex defined at said bottom-most tip thereof.

* * * * *